US007731147B2

(12) United States Patent
Rha

(10) Patent No.: US 7,731,147 B2
(45) Date of Patent: Jun. 8, 2010

(54) UNIVERSAL BOOKHOLDER

(75) Inventor: Sang-Hoon Rha, Seoul (KR)

(73) Assignee: Soon-Ja Cho, Seoul (KR)

( * ) Notice: Subject to any disclaimer, the term of this patent is extended or adjusted under 35 U.S.C. 154(b) by 1028 days.

(21) Appl. No.: 10/569,102

(22) PCT Filed: Jan. 15, 2004

(86) PCT No.: PCT/KR2004/000064

§ 371 (c)(1),
(2), (4) Date: Feb. 22, 2006

(87) PCT Pub. No.: WO2005/018381

PCT Pub. Date: Mar. 3, 2005

(65) Prior Publication Data

US 2007/0007422 A1 Jan. 11, 2007

(30) Foreign Application Priority Data

Aug. 26, 2003 (KR) ..... 10-2003-0059081
Dec. 30, 2003 (KR) ..... 10-2003-0100107

(51) Int. Cl.
*A47B 97/04* (2006.01)

(52) U.S. Cl. ..... 248/447; 248/451; 248/457

(58) Field of Classification Search ..... 248/441.1, 248/445, 447, 451, 452, 453, 461; 281/45–50; 108/3; D19/88, 91
See application file for complete search history.

(56) References Cited

U.S. PATENT DOCUMENTS 1,654,191 A * 12/1927 Redies ..... 281/34
1,728,431 A * 9/1929 Mevi ..... 281/33
1,862,562 A * 6/1932 Aldeen et al. ..... 248/447
3,408,032 A * 10/1968 Francis ..... 248/450
4,561,623 A * 12/1985 Shepherd et al. ..... 248/447
4,605,246 A * 8/1986 Haas et al. ..... 462/78
5,037,057 A * 8/1991 Andrews ..... 248/460
5,375,806 A * 12/1994 Debus et al. ..... 248/452
6,220,559 B1 * 4/2001 Chow ..... 248/445

(Continued)

FOREIGN PATENT DOCUMENTS

CA 2131402 9/1994

(Continued)

OTHER PUBLICATIONS

Search Report issued in International Patent Application No. PCT/KR2004/000064 on May 22, 2004.

*Primary Examiner*—Gwendolyn Baxter
(74) *Attorney, Agent, or Firm*—Stein McEwen, LLP

(57) ABSTRACT

A universal bookholder which receives a book therein in a folder type, and which is portable and usable anywhere at any time to allow a user to read a book thereon is disclosed.

The universal bookholder includes a pair of cover members for forming an inner space to receive a book therein when being folded and for supporting both sides of the book when being opened, a supporting unit combined between the pair of cover members so as to be folded with the cover members, a string installed in the supporting unit to traverse papers of the book for fixing the received book, at least one guide member mounted in the pair of cover members, and a clamp movably combined to the guide member for fixing a paper of the received book.

9 Claims, 9 Drawing Sheets

U.S. PATENT DOCUMENTS

| | | | | |
|---|---|---|---|---|
| 6,971,621 | B2 * | 12/2005 | Gaines | 248/447 |
| 7,240,887 | B2 * | 7/2007 | Buote | 248/447 |
| 2001/0011819 | A1 | 8/2001 | Tao | |

FOREIGN PATENT DOCUMENTS

| | | |
|---|---|---|
| CA | 2214953 | 9/1997 |
| JP | 7-313260 | 12/1995 |
| JP | 2001-218630 | 8/2001 |
| JP | 2002-58542 | 2/2002 |
| KR | 0179235 | 11/1998 |
| RU | 2 104 160 | 2/1998 |
| RU | 2 127 539 | 3/1999 |

* cited by examiner

UNIVERSAL BOOKHOLDER

CROSS-REFERENCE TO RELATED APPLICATIONS

This application claims the benefit of PCT International Patent Application No. PCT/KR2004/000064, filed Jan. 15, 2004, Korean Patent Application No. 2003-100107, filed Dec. 30, 2003, in the Korean Intellectual Property Office, and Korean Patent Application No. 2003-59081, filed Aug. 26, 2003, in the Korean Intellectual Property Office, the disclosures of which are incorporated herein by reference.

BACKGROUND OF THE INVENTION

1. Field of the Invention

The present invention relates to a bookholder, and more particularly to a universal bookholder receiving a book in a folder type so that the book may be carried easily, thereby enabling users to read the book anywhere at any time.

2. Description of the Related Art

A bookholder is generally mounted on a table to facilitate reading a book. The bookholder basically includes a stand for putting a book thereon, a support assembly for adjusting the stand at a certain angle to conform to the level of vision, and a clamp for biasing papers of the book. There have been proposed various kinds of bookholders with such basic configuration.

However, these bookholders are designed to be used on a table in a school, library or study room, so they are not useful while a user is moving outdoors. Thus, there is a need for a portable bookholder which allows a student who is struggling for studying even on their way to school and home, or a worker who uses public transportation for commuting to enjoy reading during his/her movement, not in a limited places such as a table. Portable bookholders which are improved for easy carrying it by reducing its weight and size are also proposed. However, they are inconvenient because a user should carry a book separate from the bookholder.

SUMMARY OF THE INVENTION

The present invention is designed to solve the problems of the prior art, and therefore the object of the invention is to provide a universal bookholder which is capable of receiving and carrying a book therein so that a user may read the book at any place.

Another object of the invention is to provide a bookholder by which users can read a book when he/she is lying down, standing or sitting down even without holding the book in his/her hands.

In order to accomplish the above object, the present invention provides a bookholder, which includes a pair of cover members for forming an inner space to receive a book therein when being folded and for supporting both sides of the book when being unfolded; a supporting unit combined between the pair of cover members so as to be folded with respect to the each cover member; a string longitudinally installed inside the supporting unit to fix the spine of the book; and at least one clamp installed inside the cover member and having a lifting unit for selectively fixing a height of the clamp depending on a thickness of the book so as to fix the pages of the received book.

Preferably, the supporting unit has a width selectively extendable depending on a thickness of the book.

Also preferably, the bookholder further comprises an illuminating unit for emitting light toward the book received in the cover member.

Preferably, a handle is provided on an outer surface of the supporting unit or the cover member.

Also, a plurality of concave grooves are prepared on an outer surface of the bookholder at regular intervals and a knob selectively fixed to the grooves is provided to the bookholder so as to facilitate easy grip of the bookholder during movement or reading.

According to another aspect of the invention, there is provided a bookholder comprising: a pair of cover members for forming an inner space to receive a book therein when being folded and for supporting both sides of the book when being unfolded; a supporting unit combined between the pair of cover members so as to be folded with respect to the each cover member, and having a receiving groove longitudinally formed thereon; a string longitudinally installed inside the supporting unit to fix the spine of the book; at least one clamp installed inside the cover member for fixing the pages of the received book; and a support assembly having a size corresponding to the receiving groove, and pivotally installed in the receiving groove by means of a hinge.

Preferably, the supporting unit has an inner space of which one end has an opening, and the bookholder further comprises a sliding support member received in the inner space of the supporting unit to slide into or out through the opening; at least one ring formed to connect a support string to the sliding support member; and a pair of auxiliary support arms installed on both sides of the sliding support member and capable of being bent.

More preferably, the supporting unit has an inner space of which one end has an opening, and the bookholder further comprises a case provided in the supporting unit and having an opening corresponding to the opening of the supporting unit; and a support assembly having a sliding support member received in the inner space of the case and sliding into or out through the opening of the supporting unit, wherein the support assembly is pivotally combined to the supporting unit.

Also, the bookholder further comprises a locking means for keeping the cover members unfolded.

Preferably, the locking means includes at least one push hook provided on either the supporting unit or the cover member; and a hook groove formed on either the cover member or the supporting unit so that the push hook is inserted therein.

As an alternative, the locking means includes a bar installed on one of the cover members; a concave groove formed on the other one of the cover members so that the bar is inserted therein; and a switch for biasing the bar toward the concave groove.

According to another aspect of the invention, there is provided a bookholder comprising: a pair of cover members for forming an inner space to receive a book therein when being folded and for supporting both sides of the book when being unfolded; a supporting unit combined between the pair of cover members so as to be folded with respect to the each cover member; a string longitudinally installed inside the supporting unit to fix the spine of the book; at least one guide member mounted inside the pair of cover members; and a clamp movably combined to the guide member for fixing the pages of the received book.

Preferably, the bookholder further comprises at least one support plate combined to an inner side of the cover member in order to support a book cover; and an elastic member for elastically biasing the support plate to hold up and support the book cover.

More preferably, the support plate has width and length extension units which are selectively extendable according to a size of the book respectively.

Also preferably, the support plate has an inclined portion for supporting an inclined book cover and a flat portion bent from the inclined portion for supporting the book cover.

Also, the bookholder may further comprise a position fixing unit selectively fixed to the supporting unit so as to adjust a length of the string depending on a size of the book.

Preferably, the bookholder further comprises a stand which the bookholder is installed.

More preferably, the stand includes a base; an arm extended from the base and having a plurality of joints to allow the bookholder to be located at a predetermined position; and a connector provided on an end of the arm and combined to a connector groove of the bookholder.

BRIEF DESCRIPTION OF THE DRAWINGS

These and other features, aspects, and advantages of preferred embodiments of the present invention will be more fully described in the following detailed description, taken accompanying drawings. In the drawings.

DETAILED DESCRIPTION OF THE EMBODIMENTS

Hereinafter, preferred embodiments of the present invention will be described in detail referring to the accompanying drawings. Prior to the description, it should be understood that the terms used in the specification and appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

Figure 1:
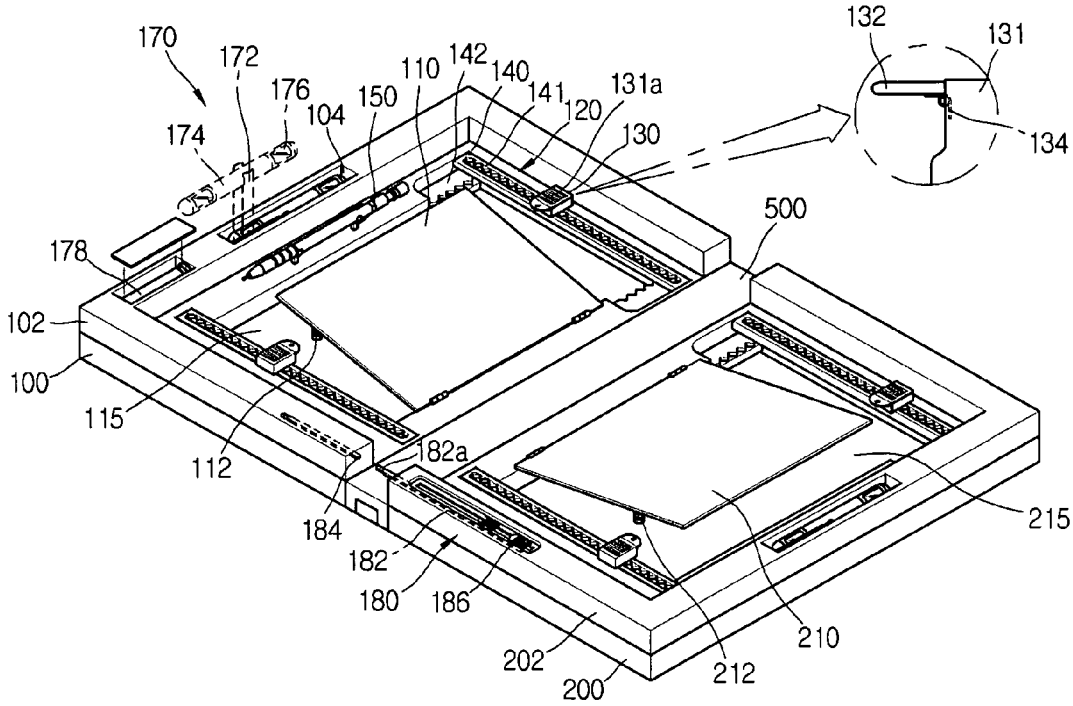
FIG. 1 is a perspective view showing a bookholder according to an embodiment of the present invention.

FIG. 1 is a perspective view schematically showing a bookholder according to an embodiment of the present invention. Referring to FIG. 1, the bookholder of this embodiment includes a pair of cover members 100 and 200, and a supporting unit 500 installed between the cover members 100 and 200.

One end of each cover member 100 or 200 is combined to the supporting unit 500, and the cover members 100 and 200 may be folded each other about the supporting unit 500 to thereby form an inner space for receiving a book therein.

Each cover member 100 or 200 has a sidewall 102 and 202 protruding a predetermined height on the edge. When the cover members 100 and 200 are folded, the sidewalls 102 and 202 form the inner space for receiving a book together with the supporting unit 500. That is to say, the sidewall 102 or 202 has a height matched to a half width of the supporting unit 500, so the sidewalls 102 and 202 contact each other along the center line of the supporting unit 500 forming an inner space when the cover members 100 and 200 are folded.

On the inner surface of the cover member 100 or 200 where a book is received, a support plate 110 or 210 for supporting a front or rear book cover in contact is installed. Specifically, a recess 115 or 215 is formed in the inner surface of the cover member 100 or 200 so that the support plate 110 or 210 may be rotated into the recess 115 or 215. The support plate 110 or 210 is configured to have size and thickness suitable for supporting general books.

Preferably, the support plate 110 or 210 is hinged to the cover member 100 or 200 so that it may be pivoted about the supporting unit 500. In addition, between the support plate 110 or 210 and a bottom of the recess 115 or 215 or at the hinged portion, an elastic member 112 or 212 such as a spring, a coil spring or a leaf spring may be provided to elastically and upwardly bias a book supported thereon. Alternatively, the support plate 110 or 210 may be installed on either of the cover members 100 and 200.

A clamping means 120 for fixing the received book is provided to the upper and/or lower end of the inner space of the cover members. Preferably, the clamping means 120 biases the upper and lower portion of the book in order to prevent unintentional turnover of the pages or movement of the book during reading.

The clamping means 120 includes a clamp 130 for suppressing the pages of the book and a guide member 140 for moving the clamp 130 in a horizontal direction.

Specifically, as shown in an enlarged view in a circle of FIG. 1, the clamp 130 includes a body 131 combined to the guide member 140 so as to be movable horizontally or widthwise with respect to the book, and a protrusion pressing unit 132 whose one end is pivotally combined to a front end of the body 131 to bias the pages of the book. Preferably, the protrusion pressing unit 132 is combined to the body 131 so as to be elastically pivotal by means of an elastic member 134. Thus, when a user pushes a page of the book down with pressing the protrusion pressing unit 132 in order to read the next page, the page is inserted with pivoting the protrusion pressing unit 132. The protrusion pressing unit 132 is then restored to its original position due to the elastic member, thereby fixing the page below it.

The clamp 130 can move along the guide member 140 so that a fixed portion of the page may be selected. For this purpose, a toothed member 141 for fixing a position of the clamp 130 is provided on the guide member 140, and an elastic protrusion 331 (see FIG. 3) of the clamp 130 is joined to a selected position of the toothed member 141. As a result, a position for fixing the page of the book may be determined by moving the clamp 130 in the horizontal direction and then positioning it at a certain position of the toothed member 141. At this time, an adjustment surface 131 a having a rough face may be provided on the upper surface of the body 131 in order to facilitate position adjustment of the clamp 130. Such a position determining means is not limited to this embodiment, but it should be understood that various modifications may be applied thereto with the use of well-known techniques.

Preferably, according to this embodiment, the guide member 140 may be configured to be movable in the vertical direction and lengthwise with respect to the book. Specifically, a vertical guide 142 having teeth is formed on the inner side of the cover member 100 or 200, and an elastic protrusion (not shown) corresponding to the teeth is formed on the guide member 140 so that the elastic protrusion is engaged at the selected position of the vertical guide 142. Thus, a user may set a vertical position of the guide member 140 according to size of the book.

On the inner side of the cover members 100 and 200, protrusions 150 for placing a pen or pencil may be provided. The protrusions 150 are spaced a predetermined distance so that the pen or pencil may be fit therebetween. In addition, it is also possible to form a receiving space in a bottom portion of the cover member 100 or 200, and then install a cover 160 (see FIG. 5) so that writing tools or scratch papers may be stored therein.

In addition, the cover members 100 and 200 may have an illuminating unit 170 for allowing a user to read the book in the dark. Preferably, the illuminating unit 170 is formed in one or both of the sidewalls of the cover members 100 and 200, and received in an insertion groove 104 so as not to obstruct opening or closing the cover members 100 and 200.

Specifically, the illuminating unit 170 includes a rotating member 172 of which one end is hinged so as to be pivotal at the insertion groove 104, and a lamp body 174 of which a center portion is rotatably hinged to the other end of the rotating member 172. The lamp body 174 has lamps 176 at both ends, and the lamps 176 may be rotated about the lamp body 174 so as to adjust an angle of the illumination.

In addition, a power source 178 for supplying power to the illuminating unit 170 is provided to the cover member 100 and/or 200. The power source 178 is installed in the sidewall adjacent to the illuminating unit 170, and preferably adopts a battery so as to ensure power supply while the bookholder is carried.

According to this embodiment, a locking unit 180 is also provided on the bookholder in order to keep the cover members 100 and 200 unfold. Preferably, the locking unit 180 includes at least one bar 182 on the upper or lower end of one of both sidewalls 102 and 202 of the cover members 100 and 200, and a hook groove 184 formed in the other one of the sidewalls 102 and 202 of the cover members 100 and 200 so that a leading end of the bar 182 may be inserted into the hook groove 184 when the cover members 100 and 200 are open. In order to insert the bar 182 into the hook groove 184, a switch 186 combined to one end of the bar 182 and exposed outward is used to push the bar 182 toward the other sidewall having the hook groove 184. At this time, it is desirable that a protrusion 182*a* is formed on the end of the bar 182 and a groove (not shown) to be engaged with the protrusion 182*a* is formed on the end of the hook groove 184 so that the inserted bar 182 is not easily taken off the hook groove 184.

Figure 2:
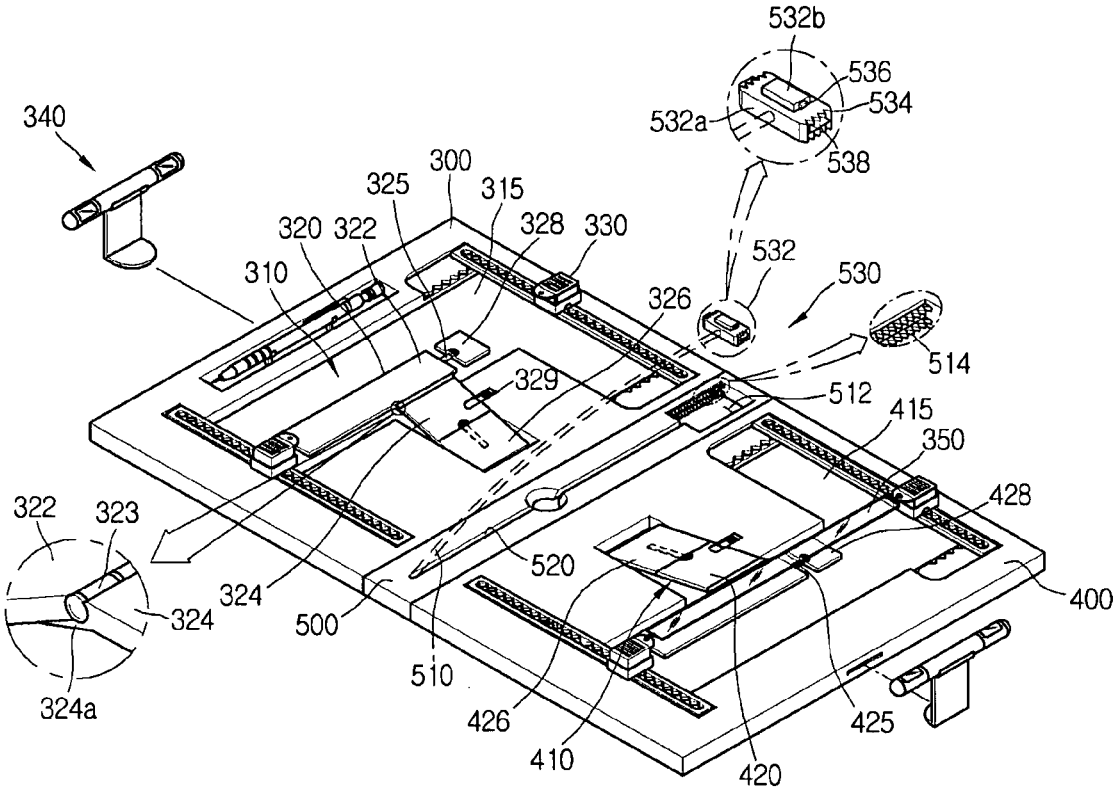
FIG. 2 is a perspective view showing a bookholder according to another embodiment of the present invention.

FIG. 2 is a perspective view schematically showing a bookholder according to another embodiment of the present invention. The following description will be focused on different parts to the former embodiment.

Referring to FIG. 2, the bookholder of this embodiment has a pair of cover members 300 and 400, which are folded about a supporting unit 500 interposed therebetween to form an inner space for receiving a book.

The bookholder of this embodiment does not have a sidewall, differently from the former embodiment. Instead, a clamp 330 and a string 510 installed in the inner side of the supporting unit suppress the book so that the book received between the cover members 300 and 400 and the supporting unit 500 is not loosened or deviated.

On the inner sides of the cover member 300 or 400 in which the book is received, a support plate 310 or 410 for supporting the book upward in contact with a book cover is formed in a recess 315 or 415. Preferably, the support plate 310 or 410 includes a support body 320 or 420, and width and length extension units 326, 328 or 426, 428 respectively connected on one side of the support body 320 or 420 by a rail 325 or 425 and selectively extendable so as to adjust its width and length according to the size of the book. One end of the width extension unit 326 or 426 is hinged to the recess 315 or 415 so as to be pivotal on the supporting unit 500.

The support body 320 has a flat portion 322 and an inclined portion 324. The flat portion 322 contacts with the book received in the cover members 300 and 400 together with the clamp 330, thereby fixing the book more firmly rather than an inclined state. For this purpose, the flat portion 322 is pivoted on the inclined portion 324 by means of a hinge 323 interposed between the flat portion 322 and the inclined portion 324, and supported by a support 324*a* provided at the lower end of the inclined portion 324, as shown in an enlarged view depicted in a circle of FIG. 2. At this time, the flat portion 322 may be elastically pivoted using a spring, not shown. If the support plate 310 is not in use, the flat portion 322 is received in the recess 315 or 415 in parallel with the inclined portion 324. At this time, the support plate which is biased upward by an elastic means (not shown) is locked with a hooking member 329 of the cover member 300 or 400.

According to this embodiment, the cover member 300 or 400 has the clamp 330 on its inner side in order to fix the pages of the received book. The clamp 330 is installed to give a pressing force opposite to a biasing direction of the support plate 310 or 410.

Figure 3:
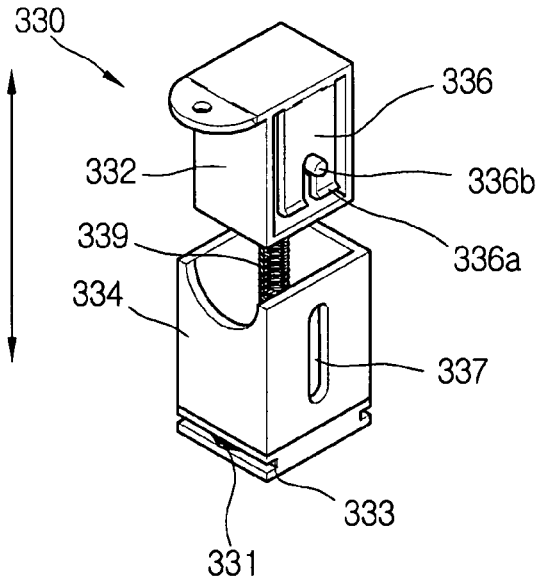
FIG. 3 is a perspective view showing a clamp moving unit of the bookholder according to another embodiment of the present invention.
Figure 4:
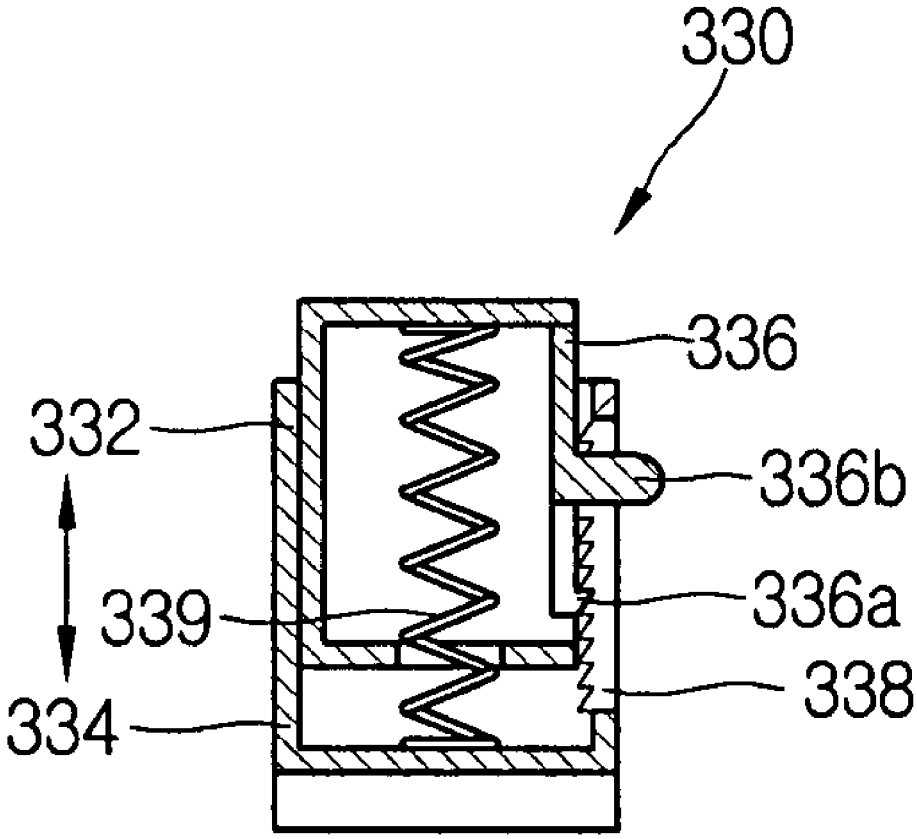
FIG. 4 is a sectional view showing a clamp moving unit of the bookholder according to another embodiment of the present invention.

FIGS. 3 and 4 are perspective view and sectional view showing the clamp 330 of this embodiment. Referring to FIGS. 3 and 4, the clamp 330 has a lifting unit for selectively extending its length according to a thickness of the book. The lifting unit has a first block 332, and a second block 334 in which the first block 332 selectively moves up and down.

Specifically, the first block 332 includes an elastic hook 336 which has a hooking protrusion 336*a* at one side, and a release protrusion 336*b* adjacent to the hooking protrusion 336*a*.

In addition, the second block 334 has a guide slot 337 on its one sidewall, and teeth 338 formed along the inner sidewall of the second block 334.

Thus, when the first block 332 is inserted into the second block 334 downward with a spring 339 interposed therebetween, the hooking protrusion 336*a* of the elastic hook 336 descends along the teeth 338 by means of its own elastic force, and then when the first block 332 is stopped at a desired position, the hooking protrusion 336*a* of the elastic hook 336 is locked with the teeth 338 to be maintained its position.

In this state, when the release protrusion 336*b* is pressed by finger in order to ascend the clamp 330, the hooking protrusion 336*a* is released from the teeth 338. Then, the first block 332 is ascended by the spring 339.

Here, the lifting unit, or the clamp 330, is not limited to this embodiment, but other techniques well known in the art may be applied thereto.

In addition, the elastic protrusion 331 prepared in the second block 334 as shown in FIG. 3 is selectively combined with the toothed member 141 of the guide member 140 described in the first embodiment. In addition, a guide protrusion 333 prevents the clamp 330 from leaving the guide member 140.

According to the present embodiment, an illuminating unit 340 is detachably installed at one or both sides of the cover members 300 and 400. This illuminating unit 340 is identical to the illuminating unit 170 of the previous embodiment, and not described in detail here. In addition, a support piece 350 for supporting the pages of the received book is provided on the cover member 300 or 400. In case that the book received in the cover members 300 and 400 is supported only by the clamp 330, the book is likely to pop out the bookholder when it is turned over. However, if the support piece 350 made of transparent material connects the opposite clamps 330 in the cover member 300 or 400, the book may be kept its position well, allowing a user to read the book.

According to this embodiment, the supporting unit 500 has a string 510 to keep the book received in the cover members 300 and 400 from falling off the bookholder when the bookholder is turned over. The string 510 is preferably made of elastic materials. Preferably, the string 510 may be received in a slit 520 formed in the supporting unit 500 lengthwise so as to press the center line of the open book.

Preferably, one end of the string 510 is fixed to the supporting unit, and the other end is fixed to a position fixing unit 530 which is provided on the supporting unit so as to adjust a length of the string 510 according to the size of the book.

Specifically, the position fixing unit 530 is configured as follows. A rectangular position fixing groove 512 is formed in one end of the supporting unit 500. Two stages of toothed members 514 for position fixing are longitudinally formed on at least one of the inner walls of the position fixing groove 512.

A position fixing pin 532 connected to the other end of the string 510 is selectively combined with the position fixing groove 512. This position fixing pin 532 has a body 532*a*, and an auxiliary body 532*b* on the body 532*a*. On both sidewalls of the body 532*a*, teeth 534 engaging with the toothed members 514 are provided. In addition, combination protrusions 538 and manipulation protrusion 536 linked with the combination protrusions 538 are formed on the body 532*a* and the auxiliary body 532*b* to be movable with respect to the body 532*a* and the auxiliary body 532*b*. Thus, if a user presses the manipulation protrusion 536, the combination protrusions 538 are moved into the body 532*a*. Preferably, the combination protrusions 538 are tapered to ease insertion.

In order to insert the position fixing pin 532 into the position fixing groove 512, the position fixing pin 532 is put so that the inclined surface of the combination protrusions 538 faces the position fixing groove 512, and then pressed. Then, the combination protrusions 538 are moved into the body 532*a* and then returned due to their own elasticity and hooked between the two-stage toothed members 514 of the position fixing groove 512. Also, the sidewall teeth 534 of the position fixing pin 532 are engaged with the two-stage toothed members 514 of the position fixing groove 512 and fixed there. Thus, the position fixing pin 532 is fixed by the combination protrusions 538 and the teeth 534, preventing it from getting out of the position fixing groove 512.

To the contrary, in order to release the position fixing pin 532 from the position fixing groove 512, a user pushes the manipulation protrusion 536 of the auxiliary body 532*b*. Then, the combination protrusions 538 moves into the body 532*a*, and the user may take out the position fixing pin 532.

Figure 5:
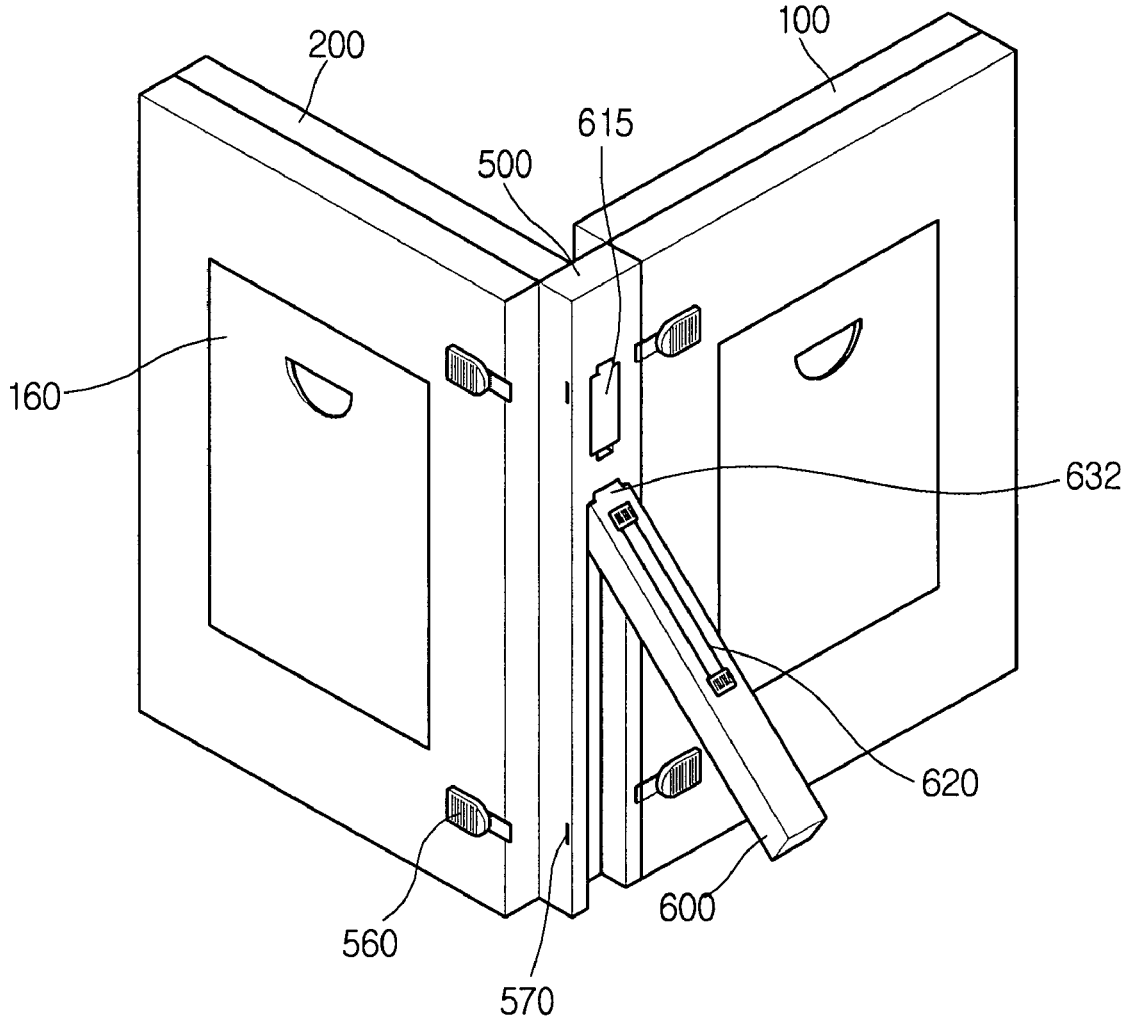
FIG. 5 is a perspective view for illustrating operation of a supporting unit according to an embodiment of the present invention.

FIG. 5 shows the supporting unit according to the former embodiment of the present invention. Here, the supporting unit of FIG. 5 may be applied to the later embodiment, not limitedly.

Referring to FIG. 5, the supporting unit 500 is provided between the cover members 100 and 200.

The supporting unit 500 includes a support assembly 600 which is adjusted at a predetermined angle so that the bookholder of the embodiment may be put on a table. The support assembly 600 is pivotal by a hinge 632 provided in a receiving groove formed along a longitudinal direction of the supporting unit. In addition, the supporting unit 500 further includes a fixing unit (not shown) for selectively fixing the support assembly 600 when the support assembly 600 is received in the receiving groove. The fixing unit may adopt various structures for attachment and detachment of the support assembly 600.

In addition, an inclination stand 615 for supporting the bookholder of this embodiment at a low angle may be pivotably mounted on the supporting unit 500. In addition, a handle 620 is attached on the surface of the support assembly 600 so that a user may insert his/her own hand or finger(s) thereto. The handle 620 may also be attached directly to the supporting unit 500 or outer sides of the cover members 300 and 400. A user may hold the handle 620 for carrying the bookholder as existing handheld bags, and particularly, the handle is useful in case that the bookholder is used not on the table but by holding with hands. That is, a user may insert his or her hand between the handle 620 and the supporting unit 500 or the cover members 300 and 400 to thereby support the bookholder, and adjust readable distance by using his/her arm. At this time, since the book is fixed by the clamp 330 and the string 510, additional support is not necessary. In doing so, the handle 620 is preferably made of various elastic materials such as an elastic band.

According to one embodiment of the present invention, the bookholder of this embodiment includes a locking unit in order to keep the cover members 100 and 200 open during reading. Preferably, the locking unit includes at least one push hook 560 provided to either the supporting unit 500 or the cover members 100 and 200, and a hook groove 570 formed in either the cover members 100 and 200 or the supporting unit 500 so that the push hook 560 is inserted therein. Thus, a user firstly unfolds the cover members 100 and 200, and then pushes the push hook 560 to be inserted into the hook groove 570, thereby keeping the cover members 100 and 200 unfolded.

Figure 6:
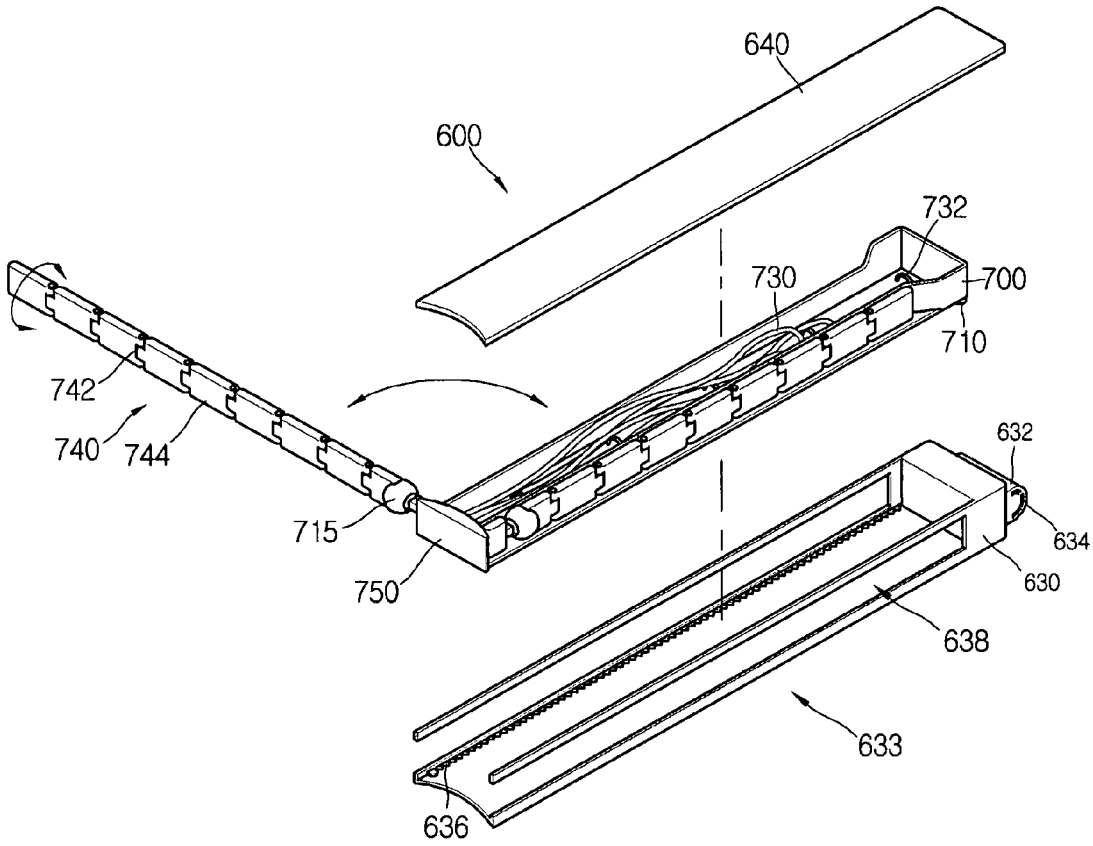
FIG. 6 is an exploded perspective view showing a support assembly according to an embodiment of the present invention.

In addition, the bookholder of the present invention may be useful for reading outdoors when the support assembly 600 of the supporting unit 500 is used. Referring to FIG. 6 showing configuration of the support assembly 600, the support assembly 600 includes a case 630, and a cover 640 for covering the case 630.

The case 630 has a hinge 632 at its one end so that it may be pivotally combined to the supporting unit 500 as described above. Preferably, an angle adjustment groove 634 is formed in the hinge 632 for adjustment of a pivot angle of the support assembly 600. The angle adjustment groove 634 is selectively combined with a protrusion (not shown) formed on the supporting unit 500 so as to set a pivot angle of the support assembly 600.

According to this embodiment, the other end of the case 630 has an opening so that a sliding support member 700 may be moved in and out through the opening. The sliding support member 700 is installed so that it may be put into or taken out of the inner space formed by the case 630 and the cover 640. The sliding support member 700 may have a suitable size in accordance with the inner space.

Preferably, the sliding support member 700 is hollow to form a receiving space therein and has a plurality of rings 732 mounted on its inner bottom. The rings 732 are used for connecting a support string 730, described later. For example, a hook, not shown, tied at one end of the support string 730 may be hooked around the ring 732.

The case 630 also has a toothed hooking member 636 on its inner side in order to set a position of the sliding support member 700 when the sliding support member 700 is taken out. An elastic hook 710 of the sliding support member 700 is selectively hooked to the toothed hooking member 636 so as to fix a position of the sliding support member 700.

According to the present invention, in case the sliding support member 700 is taken out when using the bookholder, a pair of auxiliary support arms 740 may be further provided for supporting the bookholder more stably. The auxiliary support arm 740 consists of a plurality of support pieces 744 connected each other by joints 742 to be bent. In addition, one end of the auxiliary support arm 740 is combined with the sliding support member by means of a ball-type hinge so that the auxiliary support arm 740 is pivotable and rotatable in directions shown by arrows in the figure. The auxiliary support arm 740 consisting of the support pieces 744 may be bent according to the curvature of human body as described later, thereby supporting the bookholder more stably. Many well-known techniques capable of realizing such a function may be applied instead of the auxiliary support arm 740.

Preferably, at a side of the sliding support member 700, a recess portion is preferably formed so that the auxiliary support arm 740 may be positioned therein. Thus, with the auxiliary support arm 740 folded at both sides, the sliding support member 700 may be inserted into the case 630. In addition, an elongated hole 638 is preferably formed in the sidewall of the case 630. The elongated hole 638 allows the auxiliary support arm 740 to be spread out with the sliding support member 700 inserted into the case 630. For example, if the bookholder is used on an uneven place such as a bed, the support assembly 600 is installed to be inclined and then the auxiliary support arms 740 are taken out and suitably pivoted or rotated so that it may be surface-contacted on the uneven place. This allows a user to read a book stably in a lying or sitting posture.

According to this embodiment, a taking-out unit for easily taking out the sliding support member 700 from the case 630 is provided at the end of the sliding support member 700.

Preferably, the taking-out unit has a grip 750 which is configured for easy grip of a user. More preferably, the grip 750 is made of rubber, or indentation may be formed on the grip for better grip.

Figure 7:
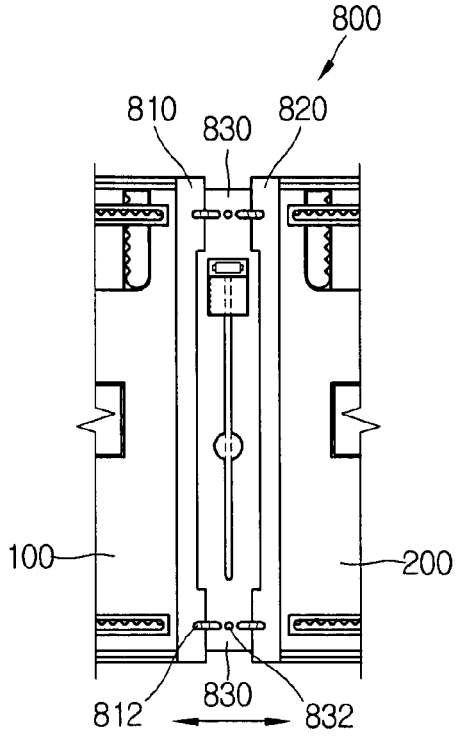
FIG. 7 shows a supporting unit according to another embodiment of the present invention.
Figure 8:
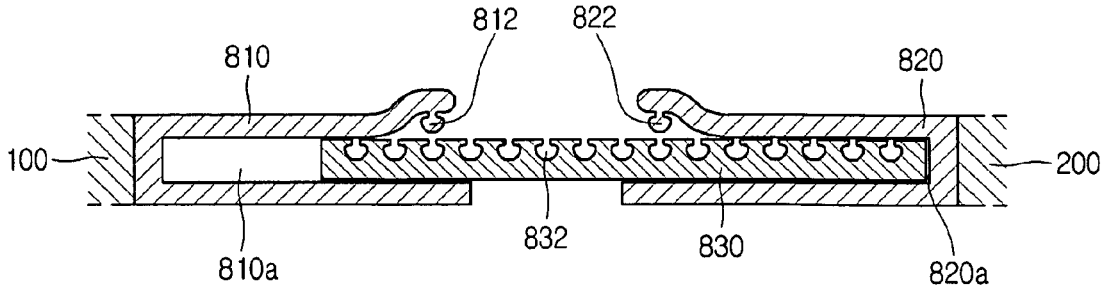
FIG. 8 is a sectional view showing the supporting unit of FIG. 7.

FIGS. 7 and 8 show a supporting unit according to another embodiment of the present invention. The supporting unit 800 of this embodiment is suitable for reading a book having a thickness larger than the width of the supporting unit in which the cover members are incompletely folded. Referring to FIGS. 7 and 8, the supporting unit 800 includes movable plates 810 and 820 which are folded with the cover members 100 and 200, and a fixed plate 830 whose both ends are inserted into slide grooves 810*a* and 820*a* of the movable plates 810 and 820. Thus, a width of the whole supporting unit 800 may be extended or shortened by moving the movable plates 810 and 820 in the opposite directions according to the thickness of the book.

In addition, the supporting unit 800 has a hooking unit for keeping the extended or shortened width of the supporting unit. That is to say, hooks 812 and 822 are mounted on the movable plates 810 and 820, and a plurality of hooking grooves 832 are formed on the surface of the fixed plate 830 at regular intervals along the width of the received book. As a result, by fitting the hooks 812 and 822 into the hooking groove 832, the supporting unit 800 may keep its width fixed.

Figure 9:
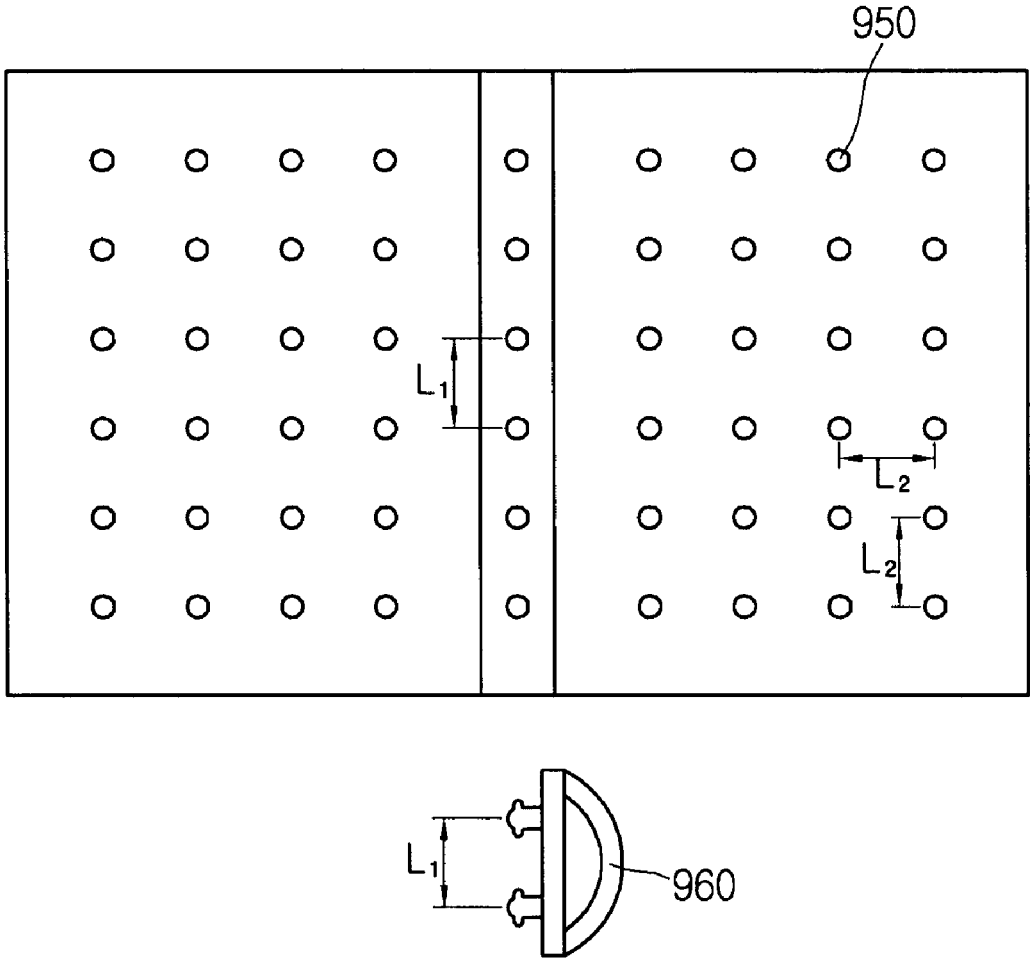
FIG. 9 is a schematic view showing a handle according to the present invention.

In addition, FIG. 9 shows a handle according to another embodiment of the present invention. Referring to FIG. 9, a plurality of concave grooves 950 are formed on the outer surface of the cover members at regular intervals. Preferably, a distance ($L_2$) between the concave grooves is identical to the distance ($L_1$) between legs of a knob, which acts as a handle. Thus, a user may hold the bookholder more easily by selectively combining the detachable knob 960 into a concave groove(s) 950 at a desired position.

Now, operation of the bookholder configured as described above according to the present invention is described in detail.

A user may carry a book in the bookholder according to the present invention, not putting the book into a separate folder or bag. That is to say, as shown in FIG. 1, the book is put into the inner space of the cover members 100 and 200 and then the cover members 100 and 200 are folded, the book may be received in the cover members 100 and 200 because the sidewalls 102 and 202 generates a sufficient inner space. In addition, in case that there is no sidewall as shown in FIG. 2, the book may be fixed in the cover members by using the clamp 330 and the string 510 mounted in the cover members 300 and 400 and the supporting unit 500.

The bookholder of the present invention may also be used on a fixed place such as a table. For example, the cover members 100 and 200 are unfolded straightly and then the push hook 560 prepared in the cover member is pushed into the hook groove 570 formed in the supporting unit 500. Then, the cover members 100 and 200 are not pivoted but fixed to the supporting unit 500. As an alternative, as shown in FIG. 1, the cover members 100 and 200 and the supporting unit 500 may be stably fixed to form the same surface with the use of the locking unit 180 having the bar 182 and the concave groove 184.

In this state, the support assembly 600 is pivoted backward with respect to the hinge to support the bookholder on the ground as shown in FIG. 5. Then, a user may read a book with the use of the bookholder of the present invention at a fixed place such as a table.

Meanwhile, in order to put a book on the bookholder, a user firstly sets a position of the bookholder, opens the book by its substantially half page, and then fits the position fixing pin 532 at a suitable position with putting the string 510 in the supporting unit across the spine of the book. Then, book covers are fixed in contact with the inner surfaces of the cover members 100 and 200. If the support plate is employed, the book is arranged so that the front cover of the book contacts with the support plate 110 and a rear cover contacts with the support plate 210. And then, the guide member 140 is vertically adjusted to conform to the size of book, and then a position of the clamp 130 is also set.

Subsequently, if a user pushes a page below the clamp 130 with turning over the page or presses the clamp 130, the protrusion pressing unit 132 is pivoted to pass the page as mentioned above. The protrusion pressing unit 132 then restores its origin state at once by means of the elastic member 134 so that the page is supported not to be turned. At this time, the support plate 110 in contact with the front cover of the book biases the book cover upward by means of the elastic member 112, so the page may be more stably supported between the clamp 130 and the support plate 110. The same principle may be applied to the rear cover of the book. If the book is thick, as shown in FIGS. 3 and 4, a thickness of the inner space of the cover members may be selectively adjusted with the use of the extendable clamp 330. In addition, a thicker book may be received in the bookholder by extending a width of the supporting unit 500 as shown in FIGS. 7 and 8.

According to the present invention, in the above state, since a user inserts one hand into the handle 620 on the outside of the supporting unit 500 or the cover members 100 and 200 to thereby uniformly transfer the center of weight through the arm, he/she can read the book in anyplace. Particularly, in a vehicle such as a subway or a bus a user can hold a handle of the vehicle by one hand with the other hand inserted into the handle 620 to support the bookholder as he/she likes, which enables a user to comfortably read the book when standing in a vehicle.

Also, when a user folds the cover members 100 and 200 of the bookholder after reading, the book is closed and received in the bookholder in a current state. Thus, if the bookholder is open later, the page of the book is open as it was. Thus, the user need not struggle to find the page which was being read before.

Figure 10:
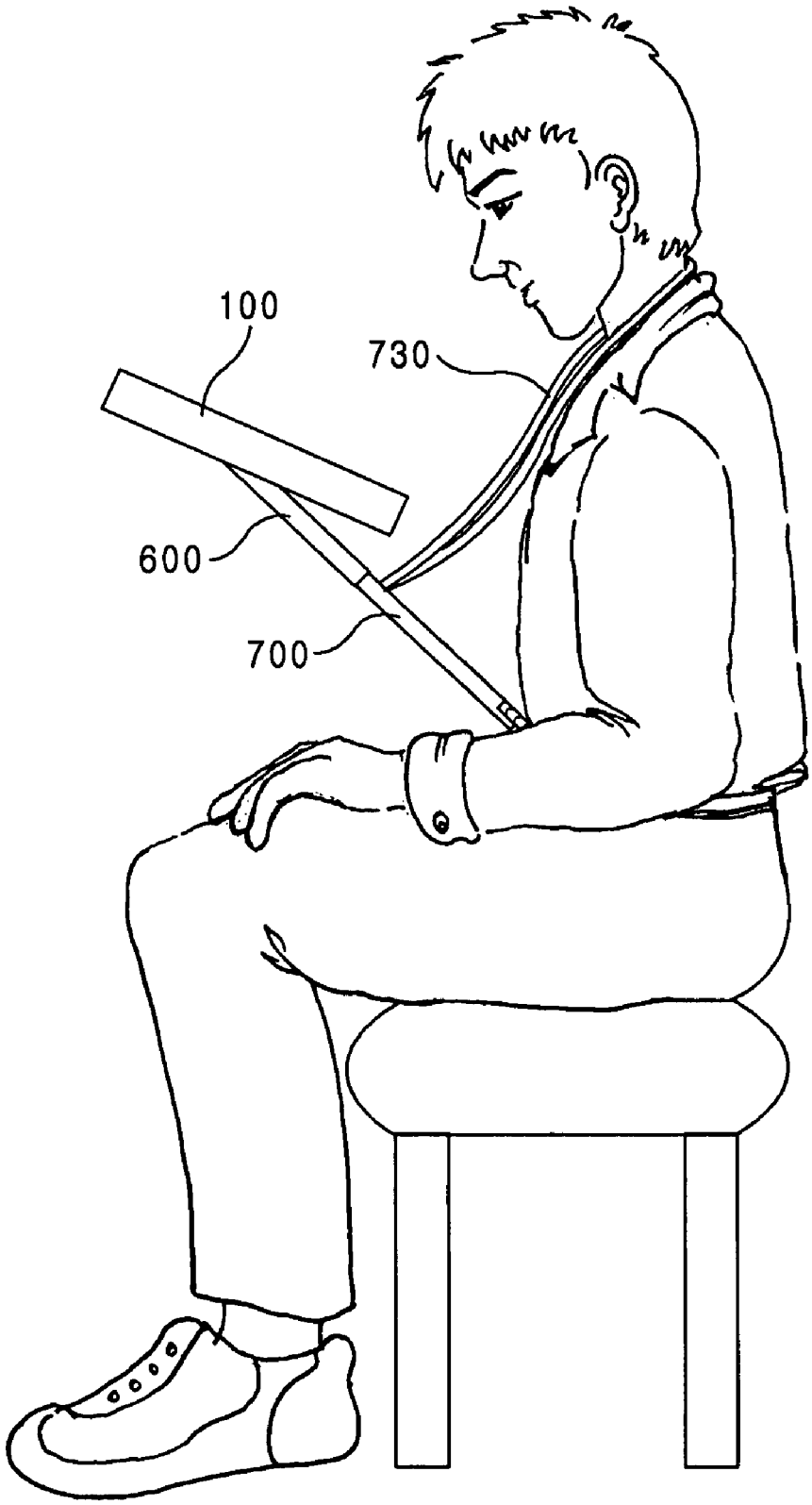
FIG. 10 shows that the bookholder according to an embodiment of the present invention is actually used.

Meanwhile, as shown in FIG. 10, if a user desires to use the bookholder without the support of hands, the user pulls the handle 750 to draw out the sliding support member 700. While the sliding support member 700 is drawn out, the elastic hook 710 comes in contact with the toothed hooking member 636 to determine its position. Thus, the sliding support member 700 may be drawn out and fixed as much as a suitable length as required.

In addition, the bookholder of the present invention may be additionally supported with the use of the support string 730 by hanging the support string 730 on the neck or the shoulder of the user. That is to say, the support string 730 may be supported around the neck or the shoulder by connecting it to at least one ring 732 mounted to the sliding support member 700. In this case, a hooking unit (not shown) having easy detachment function is prepared to the support string 730, thereby facilitating easy connection between the support string 730 and the ring 732. In addition, for more stable support, the support string 730 is preferably connected to a ring 732 which is positioned at a substantial center between the upper end of the bookholder and the end of the drawn sliding support member 700.

According to the present invention, in order to support the bookholder better, the auxiliary support arms 740 may be used. That is to say, if the auxiliary support arms 740 are spread and then put on the body of the user with suitable bending of the joints 742, the bookholder may be supported more stably without lateral shaking.

Figure 11:
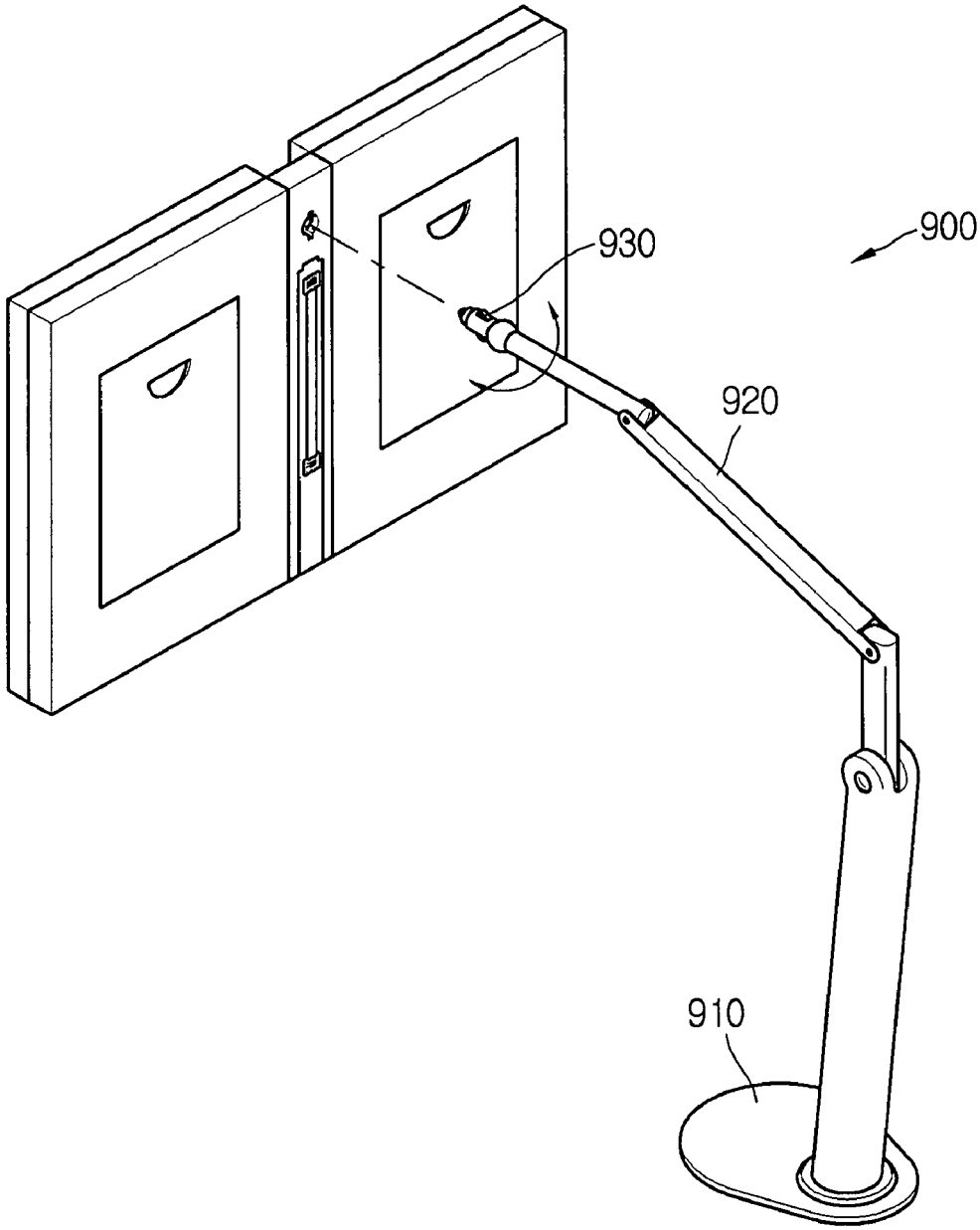
FIG. 11 shows a stand of the bookholder according to the present invention.

FIG. 11 shows a stand for fixing the bookholder of the present invention. Referring to FIG. 11, the bookholder may be selectively combined to a stand 900 of a predetermined structure.

The stand 900 includes a base 910, an arm 920 extended from the base 910 and having plural joints for free movement, and a connector 930 prepared at the end of the arm 920 and combined with the bookholder.

The base 910 has sufficient weight and size so that the bookholder combined to the stand does not fall down, and a support clamp, not shown, may also be provided to the base. The arm 920 has at least two joints so that a user may read a book with the use of the bookholder in any posture. In addition, the connector 930 is configured to ensure power supply to the bookholder. For example, the power supply may be directly supplied from an external source to the illustrating unit. In addition, this process also may charge a power source 178 which is installed in the sidewall 102.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

INDUSTRIAL APPLICABILITY

The universal bookholder of the present invention has effects as follows.

First, since the bookholder may be carried together with a book, the volume of the bookholder and the book is decreased than when they are carried separately. In addition, a user may carry the book and the bookholder more easily.

Second, the book received in the cover members may be kept so that it may be open as it was. In addition, since the bookholder may store various pens and scratch papers, the bookholder is useful outdoors.

Third, the bookholder may facilitate reading of a user who is standing in a vehicle such as a subway or a bus. Because a user who is standing in a vehicle wants to read a book, he can hold a handle of the vehicle safely by one hand by virtue of the other hand which is inserted into the handle on the outer side of the bookholder. At this time, the current page of the book is fixed by the clamp and the string, which prevents the book from leaving its position. As a result, a user does not need to struggle to hold both pages by one hand but simply insert his/her hand into the handle, and then may read easily and safely even standing in a vehicle.

Fourth, the bookholder may conveniently keep a book of a certain weight within a readable distance with its pages fixed without being supported by user's hands.

Fifth, the bookholder is useful while a user is moving, and the bookholder may also be put on a table. In addition, if being combined with a stand, the bookholder may be positioned within a readable distance by moving joints of the stand, so a user may read a book on the bookholder in various postures and at various angles. The bookholder even makes it possible that a user who is lying reads a book.

Sixth, the bookholder allows a user to read a book with the use of the illustrating unit mounted thereto without any separate light source in a dark place.

Seventh, since the cover members cover and protect the book, a user can hide the book covers that he or she does not want to show to others. Also, the book inside the bookholder can be prevented from the physical impact or outer environment. In addition, the cover members give various visual effects according to user's taste.

Eighth, the bookholder can be a base on which various elements that facilitate reading may be collected.

What is claimed is:

1. A bookholder, comprising:

a pair of cover members for forming an inner space to receive a book therein when being folded and for supporting both sides of the book when being unfolded;

a supporting unit combined between the pair of cover members so as to be folded with respect to the each cover member;

a string longitudinally installed inside the supporting unit to fix the spine of the book; and at least one clamp installed inside the cover member so as to fix the pages of the received book, wherein the clamp has a lifting unit for selectively fixing a height of the clamp depending on a thickness of the book, wherein the lifting unit comprises a first block, and a second block in which the first block selectively moves up and down, wherein the first block includes a hooking protrusion at one side, and wherein the second block has teeth which is formed along the inner sidewall of the second block so as to engage with the hooking protrusion selectively.

2. A bookholder according to claim 1, further comprising:

a release protrusion capable of controlling the locking between the hooking protrusion and the teeth; and a spring for ascending the first block.

3. A bookholder, comprising:

a pair of cover members for forming an inner space to receive a book therein when being folded and for supporting both sides of the book when being unfolded;

a supporting unit combined between the pair of cover members so as to be folded with respect to the each cover member;

a string longitudinally installed inside the supporting unit to fix the spine of the book; and at least one clamp installed inside the cover member so as to fix the pages of the received book, wherein the clamp has a lifting unit for selectively fixing a height of the clamp depending on a thickness of the book, wherein the lifting unit comprises a first block, and a second block in which the first block selectively moves up and down, wherein the first block includes an elastic hook which has a hooking protrusion at one side and a release protrusion adjacent to the hooking protrusion, wherein the second block has a guide slot on its one sidewall and teeth formed along the inner sidewall of the second block, and wherein the bookholder further comprises a spring for ascending the first block.

4. A bookholder, comprising:

a pair of cover members for forming an inner space to receive a book therein when being folded and for supporting both sides of the book when being unfolded;

a supporting unit combined between the pair of cover members so as to be folded with respect to the each cover member;

a string longitudinally installed inside the supporting unit to fix the spine of the book; and at least one clamp installed inside the cover member so as to fix the pages of the received book, wherein a vertical guide having teeth is formed on the inside of the cover member longitudinally, and an elastic protrusion corresponding to the teeth is formed on the guide member so that the elastic protrusion is engaged at the selected position of the vertical guide.

5. A bookholder, comprising:

a pair of cover members for forming an inner space to receive a book therein when being folded and for supporting both sides of the book when being unfolded;

a supporting unit combined between the pair of cover members so as to be folded with respect to the each cover member;

a string longitudinally installed inside the supporting unit to fix the spine of the book; and at least one clamp installed inside the cover member so as to fix the pages of the received book, wherein the clamp has a lifting unit for selectively fixing a height of the clamp depending on a thickness of the book, and the bookholder further comprising a locking means for keeping the cover members unfolded, wherein the locking means comprises:

at least one push hook provided on either the supporting unit or the cover member; and a hook groove formed on either the cover member or the supporting unit so that the push hook is inserted therein.

6. A bookholder, comprising:

a pair of cover members for forming an inner space to receive a book therein when being folded and for supporting both sides of the book when being unfolded;

a supporting unit combined between the pair of cover members so as to be folded with respect to the each cover member;

a string longitudinally installed inside the supporting unit to fix the spine of the book; and at least one clamp installed inside the cover member so as to fix the pages of the received book, wherein the clamp has a lifting unit for selectively fixing a height of the clamp depending on a thickness of the book, and the bookholder further comprising a locking means for keeping the cover members unfolded, wherein the locking means comprises:

a bar installed on one of the cover members;

a hook groove formed on the other one of the cover members so that the bar is inserted therein; and a switch for biasing the bar toward the hook groove.

7. A bookholder, comprising:

a pair of cover members for forming an inner space to receive a book therein when being folded and for supporting both sides of the book when being unfolded;

a supporting unit combined between the pair of cover members so as to be folded with respect to the each cover member;

a string longitudinally installed inside the supporting unit to fix the spine of the book;

at least one clamp installed inside the cover member so as to fix the pages of the received book;

at least one support plate combined to an inner side of the cover member in order to support a book cover; and an elastic member for elastically biasing the support plate to hold up and support the book cover, wherein the support plate has width and length extension units which are selectively extendable according to a size of the book respectively.

8. A bookholder, comprising:

a pair of cover members for forming an inner space to receive a book therein when being folded and for supporting both sides of the book when being unfolded;

a supporting unit combined between the pair of cover members so as to be folded with respect to the each cover member;

a string longitudinally installed inside the supporting unit to fix the spine of the book;

at least one clamp installed inside the cover member so as to fix the pages of the received book;

at least one support plate combined to an inner side of the cover member in order to support a book cover; and an elastic member for elastically biasing the support plate to hold up and support the book cover, wherein the support plate has an inclined portion for supporting an inclined book cover and a flat portion bent from the inclined portion for supporting the book cover.

9. A bookholder, comprising:

a pair of cover members for forming an inner space to receive a book therein when being folded and for supporting both sides of the book when being unfolded;

a supporting unit combined between the pair of cover members so as to be folded with respect to the each cover member;

a string longitudinally installed inside the supporting unit to fix the spine of the book;

at least one clamp installed inside the cover member so as to fix the pages of the received book;

at least one support plate combined to an inner side of the cover member in order to support a book cover;

an elastic member for elastically biasing the support plate to hold up and support the book cover;

a recess inside the cover member so as to receive the support plate therein; and a hooking member inside the cover member so as to lock the support plate which is received in the recess when not in use.

* * * * *